US008910577B2

(12) United States Patent
Irion et al.

(10) Patent No.: US 8,910,577 B2
(45) Date of Patent: Dec. 16, 2014

(54) RAIL CRIBBER

(71) Applicant: Nordco Inc., Oak Creek, WI (US)

(72) Inventors: Allan Irion, Milwaukee, WI (US); David Paton, Sussex, WI (US)

(73) Assignee: Nordco, Inc., Oak Creek, WI (US)

( * ) Notice: Subject to any disclaimer, the term of this patent is extended or adjusted under 35 U.S.C. 154(b) by 44 days.

(21) Appl. No.: 13/712,452

(22) Filed: Dec. 12, 2012

(65) Prior Publication Data

US 2014/0158011 A1 Jun. 12, 2014

(51) Int. Cl.
*E01B 29/05* (2006.01)
*E01B 29/10* (2006.01)
*E01B 27/04* (2006.01)

(52) U.S. Cl.
CPC ..... *E01B 29/10* (2013.01); *E01B 27/04* (2013.01)
USPC ..... 104/2; 104/16

(58) Field of Classification Search
USPC ..... 104/2, 3, 16, 17.1, 17.2
See application file for complete search history.

(56) References Cited

U.S. PATENT DOCUMENTS

| | | | | |
|---|---|---|---|---|
| 1,588,801 | A | 6/1926 | Overmier | |
| 1,691,933 | A | 11/1928 | Overmier | |
| 2,743,539 | A * | 5/1956 | Hursh et al. | 37/104 |
| 2,846,206 | A * | 8/1958 | Kershaw | 37/104 |
| 3,553,859 | A * | 1/1971 | McIlrath | 37/104 |
| 3,826,195 | A * | 7/1974 | Bucksch | 104/2 |
| 3,948,185 | A | 4/1976 | Settle et al. | |
| 5,046,270 | A * | 9/1991 | Theurer et al. | 37/104 |
| 5,125,345 | A | 6/1992 | Theurer et al. | |
| 5,907,914 | A * | 6/1999 | Theurer | 37/105 |
| 5,926,981 | A * | 7/1999 | Theurer | 37/104 |
| 6,463,858 | B2 * | 10/2002 | Weber et al. | 104/9 |
| 6,598,325 | B2 * | 7/2003 | Theurer et al. | 37/104 |
| 8,171,855 | B2 * | 5/2012 | Noll et al. | 104/16 |
| 8,534,195 | B2 * | 9/2013 | Noll et al. | 104/16 |
| 2002/0129729 | A1 * | 9/2002 | Weber et al. | 104/9 |
| 2013/0125775 | A1 * | 5/2013 | Brenny et al. | 104/2 |

OTHER PUBLICATIONS

See Co-pending patent U.S. Appl. No. 29/439,566, filed Dec. 12, 2012.

* cited by examiner

*Primary Examiner* — Jason C Smith
(74) *Attorney, Agent, or Firm* — Greer, Burns & Crain Ltd.

(57) ABSTRACT

A cribbing work head including a work head frame having a longitudinal extent and a lateral extent. At least two inverted U-shaped work arms are mounted parallel to one another on the work head frame and spaced longitudinally from each other for lateral reciprocating movement on the frame, each of the work arms having a replaceable tool secured to each free end of the inverted U-shaped work arm. A separate fluid power double cylinder is secured to the work head frame and to each of the inverted U-shape work arms for independently laterally reciprocating the work arms. A main cylinder of each of said fluid power double cylinders is operable to laterally reciprocatingly move a respective work arm and a secondary cylinder of each of the fluid power double cylinders operable to move a respective work arm to one of two discrete lateral starting points.

20 Claims, 15 Drawing Sheets

RAIL CRIBBER

BACKGROUND OF THE INVENTION

The present invention relates to rail maintenance equipment, and specifically to maintenance equipment for removing ballast from a railway track bed and moving a railroad tie located on the track bed.

It is known to provide a machine for clearing the ballast from a crib (space between adjacent ties) in a railway track by repeatedly pushing the ballast from the center of the track laterally outwardly by two different arms or to provide a machine for clearing the ballast from a crib by pushing the ballast completely from one side of the track to the other. These known machines are described in U.S. Pat. Nos. 1,588,801; 1,691,933; 2,743,539; 2,846,206; 3,553,859; 3,826,195; 3,948,185; 5,046,270; 5,125,345; 5,907,914; 5,926,981; and 6,598,325. While in some situations, it is desirable to remove all of the ballast to one side or the other, and in other situations it is desirable to remove the ballast to both sides in relatively equal amounts, no machines are provided that allow the operator to choose between these different clearing options. That is, known machines either clear to one side or the other, or else only clear from the middle outwardly.

Also, while some machines are provided with a tool for engaging and moving the ballast under the track itself, such tools are configured for use specifically with the particular machine they are designed for.

The known cribbing machines are provided with manual controls for moving the various arms and tools, but are not provided with electronic controls that limit the movement of the frames, arms and tools to prevent the frames, arms and tools from striking the track as the ballast is being removed.

Further, once the ballast has been cleared away from the tie, the known machines are not equipped to move the tie, and instead, a different machine is required for that step of the process.

SUMMARY OF THE INVENTION

The present invention provides a cribbing machine that addresses the shortcomings of the prior art. A cribbing machine according to the invention allows the operator to select a ballast removal operation in which all of the ballast is cleared to the left side of the track, all of the ballast is cleared to the right side of the track or the ballast is cleared to both the right side and the left side of the track from the center of the track. An electronic control is provided for sensing the position of the arms and tools so that they do not strike the rails of the track. A tie kicker is provided on the machine to push a tie into a trough made by the removal of the ballast from an adjacent crib. Efficient removable tools are provided for the work arms which actually engage the ballast, and which can be removed and replaced as they wear from use in scraping the ballast.

In an embodiment of the invention a cribbing work head is provided having a work head frame with a longitudinal extent and a lateral extent. At least two inverted U-shaped work arms are mounted parallel to one another on the work head frame and spaced longitudinally from each other for lateral reciprocating movement on the frame, each of the work arms having a replaceable tool secured to each free end of the inverted U-shaped work arm. A separate fluid power double cylinder is secured to the work head frame and to each of the inverted U-shape work arms for independently laterally reciprocating the work arms. A main cylinder of each of the fluid power double cylinders is operable to laterally reciprocatingly move a respective work arm and a secondary cylinder of each of the fluid power double cylinders is operable to move a respective work arm to one of two discrete lateral starting points.

In an embodiment, each of the inverted U-shaped work arms comprises a horizontal beam arranged to slide laterally relative to the work head frame, a first depending arm being secured at a top end to one end of the horizontal beam and having one of the replaceable tools removably mounted to a bottom end thereof, and a second depending arm being secured at a top end to an opposite end of the horizontal beam and having one of the replaceable tools removably mounted to a bottom end thereof.

In an embodiment, the replaceable tool mounted to the first depending arm extends laterally toward the second depending arm and the replaceable tool mounted to the second depending arm extends laterally toward the first depending arm.

In an embodiment, each of the fluid power double cylinders comprises the main cylinder secured to an end of the secondary cylinder such that the main cylinder and the secondary cylinder are arranged on a common axis.

In an embodiment, each tool extends laterally from the end of the inverted U-shaped work arm for a distance of 4 to 10 inches.

In an embodiment, the main cylinder is mounted and oriented such that it can move its respective inverted U-shaped work arm in either lateral direction.

In an embodiment, there are four inverted U-shaped work arms slidably mounted on the work head frame.

In an embodiment, a cribbing machine is provided which is configured for selectively moving ballast from at least one railway crib to one lateral side of the railway track, to an opposite side of the railway track, or to both lateral sides of the railway track. In this embodiment, the cribbing machine includes a machine frame having a front frame end and a rear frame end and extending in a longitudinal direction from the front frame end to the rear frame end.

A work head frame having a longitudinal extent and a lateral extent is mounted laterally on the machine frame and is reciprocably movable vertically relative to the railway track between a working position and a travel position. At least two inverted U-shaped work arms are mounted parallel to one another on the work head frame and spaced longitudinally from each other for lateral reciprocating movement on the work head frame. Each of the work arms has a replaceable tool secured to each free end of the inverted U-shaped work arm. A separate fluid power double cylinder is secured to the work head frame and to each of the inverted U-shape work arms for independently laterally reciprocating the work arms.

A main cylinder of each of the fluid power double cylinders is operable to laterally reciprocatingly move a respective work arm and a secondary cylinder of each of the fluid power double cylinders is operable to move a respective work arm to one of two discrete lateral starting points. A control system is connected to each of the fluid power double cylinders to selectively operate the main cylinders and secondary cylinders to laterally move the work arms in a manner depending on an operational sequence determined by the control system.

In an embodiment, a tie pusher is mounted on the machine frame and is arranged to push a tie in a longitudinal direction relative to the machine frame.

In an embodiment, the main cylinder of each of the fluid power double cylinders includes an internal sensor arranged to provide position feedback to the control system such that an extension position of the main cylinder can be controlled by the control system.

In an embodiment, the control system includes a PLC controller.

In an embodiment, a tool is provided for use with a rail maintenance cribber having at least one laterally moving work arm having a downwardly facing free end. The tool is configured for attachment to the downwardly facing free end. The tool includes a tool body having a mounting area and a first ballast pusher end, the first ballast pusher end including at least one substantially vertical surface. The tool body also has a vertically extending second ballast pusher end spaced from the first ballast pusher end.

In an embodiment, the first ballast pusher end has a lower serrated edge.

In an embodiment, the second ballast pusher end has a lower serrated edge.

In an embodiment, the first ballast pusher end is held apart from the second ballast pusher end by a substantially horizontal wall.

In an embodiment, the first ballast pusher end is held apart from the second ballast pusher end by a substantially vertical wall.

In an embodiment, the mounting area and the first ballast pusher end are formed on a single plate.

DETAILED DESCRIPTION OF THE PREFERRED EMBODIMENTS

Figure 1:
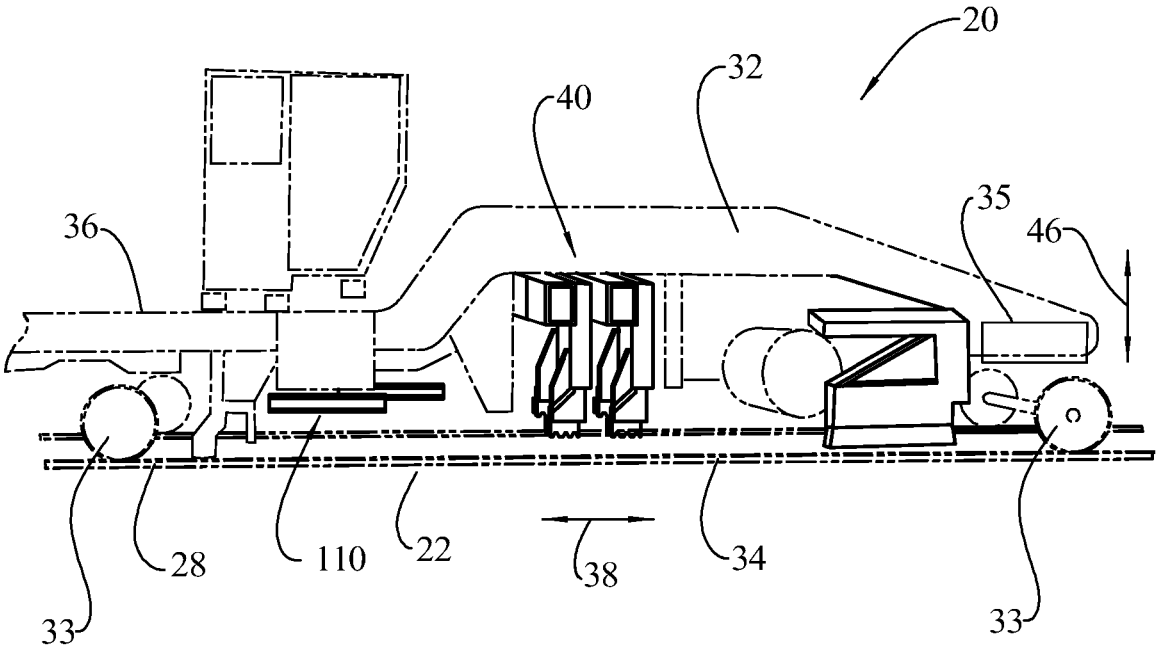
FIG. 1 is a side elevational view of a cribbing machine on a railway track.

An embodiment of the invention is illustrated in the FIGs. in which a cribbing machine 20 (FIG. 1) is provided which is configured for selectively moving ballast 22 (FIG. 1) from at least one railway crib 24 (FIG. 24) to a first (left) lateral side 26 (FIG. 8) of a bed of a railway track 28, to an opposite (right) side 30 of the railway track bed, or to both lateral sides of the railway track bed.

In this illustrated embodiment, the cribbing machine 20 includes a machine frame 32 (FIG. 1) carried on wheels 33 for rolling on rails 34 of the railway track 28 and having a front frame end 35 and a rear frame end 36 and extending in a longitudinal direction (arrow 38) from the front frame end 35 to the rear frame end 36. The longitudinal direction corresponds to a direction of travel of the cribbing machine 20 along the railway track 28.

Figure 2:
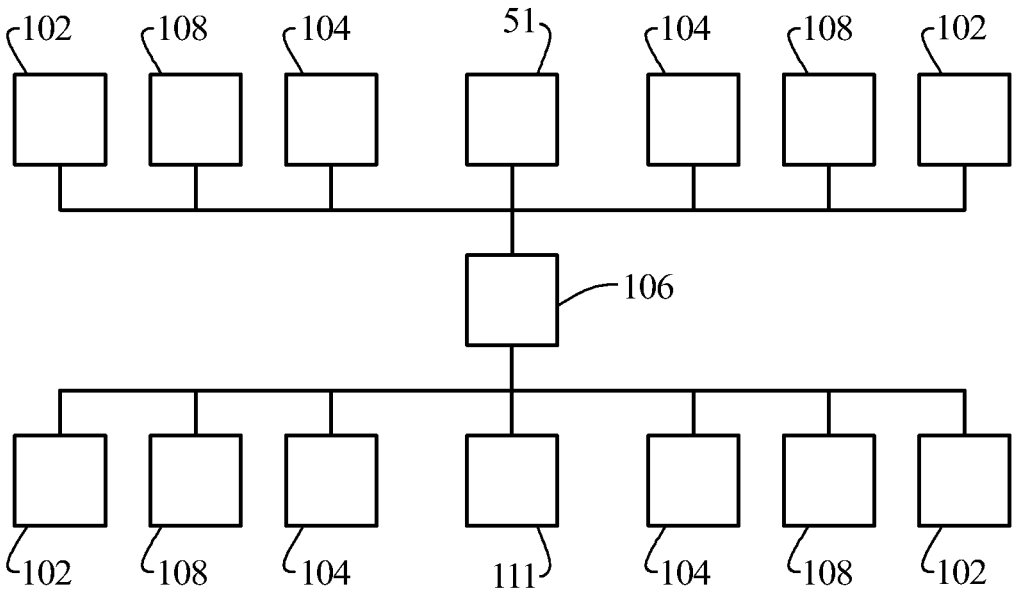
FIG. 2 is a schematic diagram of the control system and controlled components of the cribbing machine of FIG. 1
Figure 6:
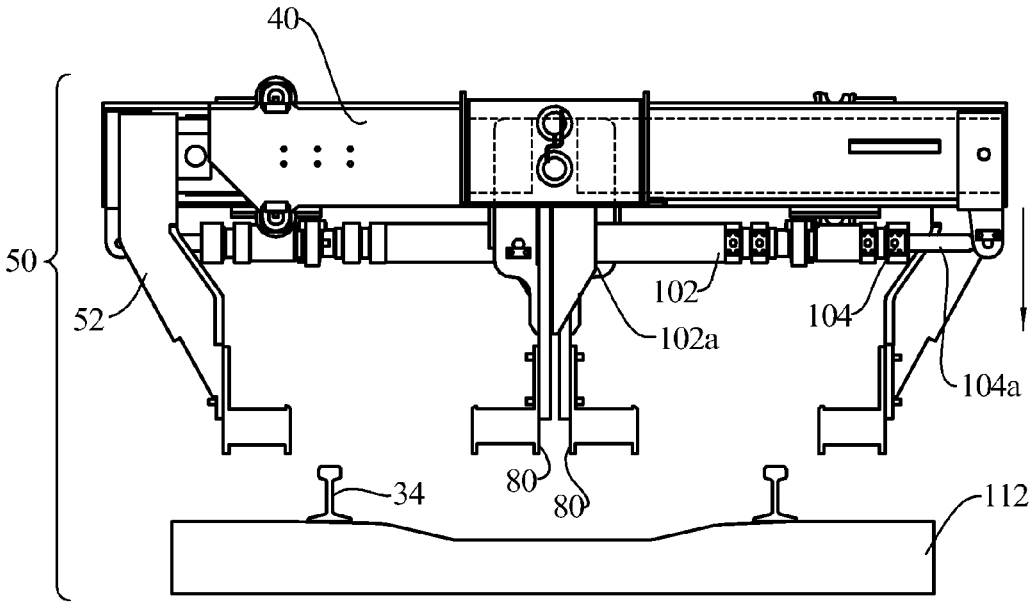
FIG. 6 is a schematic view of a pair of work arms in an elevated home position for moving ballast to both lateral sides of the track.
Figure 12:
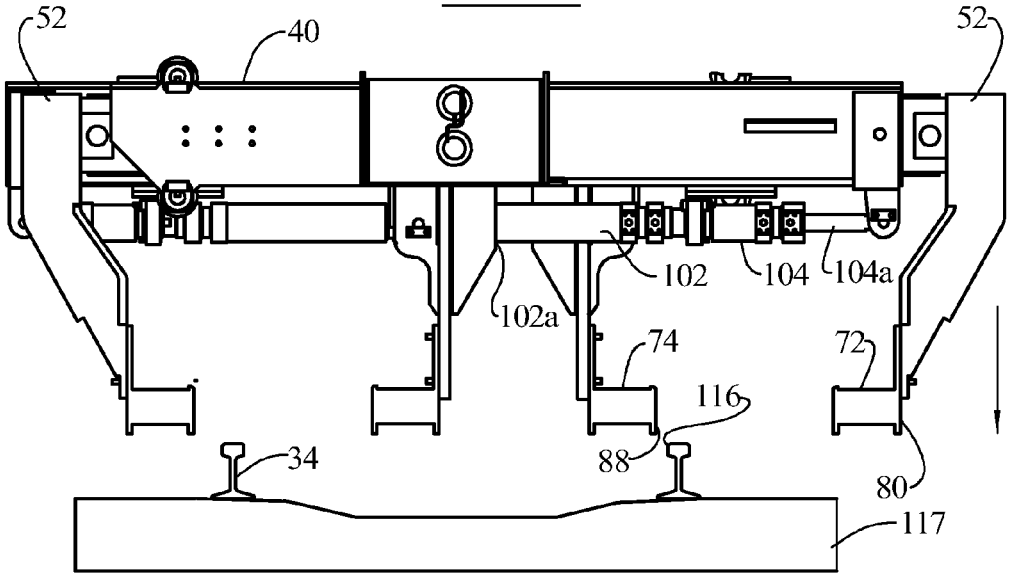
FIG. 12 is a schematic view of a pair of work arms in an elevated home position for moving ballast to a left lateral side of the track.
Figure 18:
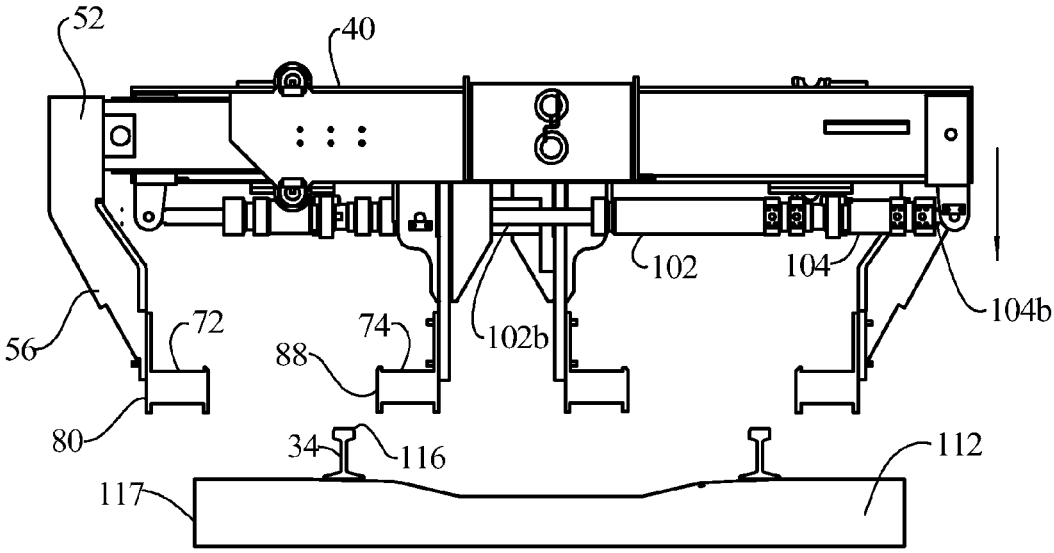
FIG. 18 is a schematic view of a pair of work arms in an elevated home position for moving ballast to the right lateral side of the track.

A work head frame 40 having a longitudinal extent and a lateral extent is mounted laterally on the machine frame 32 and is reciprocably movable vertically (arrow 46) relative to the rails 34 between a working position 48 (FIGS. 7, 13, 19) and a travel position 50 (FIGS. 6, 12, 18). The work head frame 40 may be raised and lowered by means 51 known in the field, such as by use of hydraulic cylinders, a rack and gear arrangement, levers, cables, and similar arrangements (FIG. 2).

Figure 3:
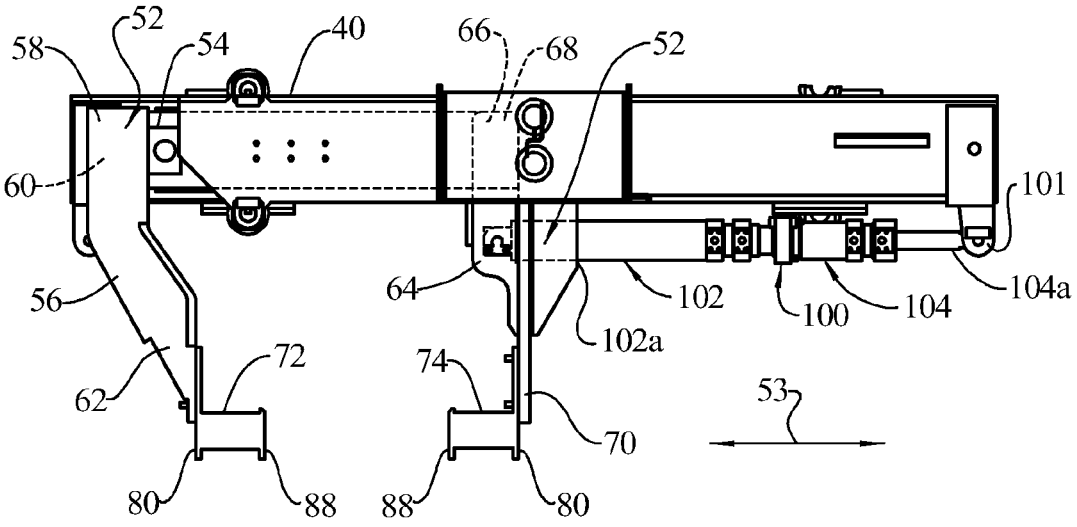
FIG. 3 is an isolated elevational view of one work arm carried on a work head frame as seen looking in a longitudinal direction of the cribbing machine of FIG. 1.
Figure 10:
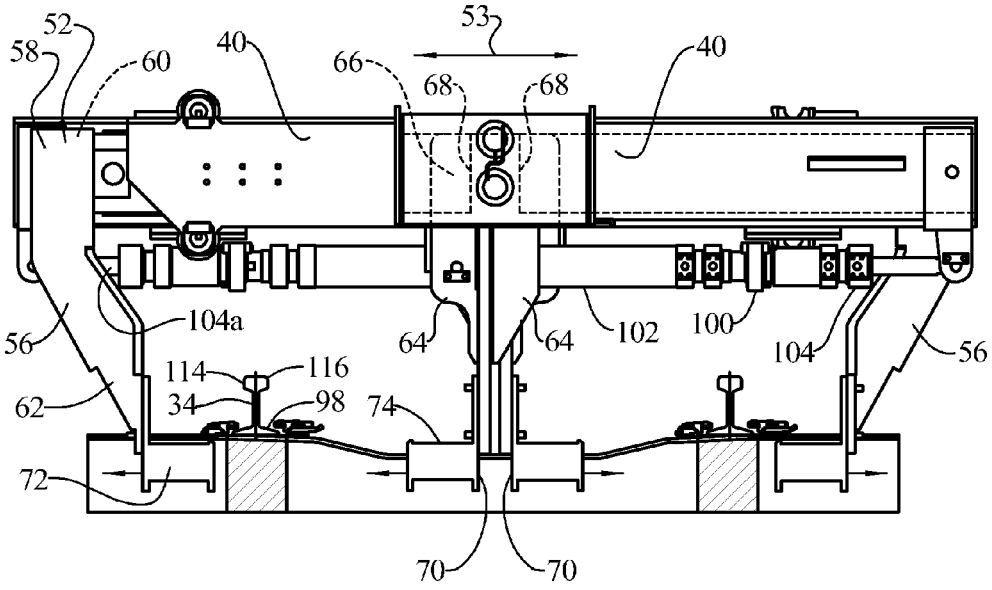
FIG. 10 an elevational view of two work arms carried on a work head frame and positioned to push ballast laterally outwardly as seen looking in a longitudinal direction of the cribbing machine of FIG. 1.

As best seen in FIGS. 3 and 10, at least two (and in the embodiment illustrated, four) inverted U-shaped work arms 52 are mounted parallel to one another on the work head frame 40 and spaced longitudinally from each other for lateral reciprocating movement (arrow 53) on the work head frame. In FIG. 3 only one inverted U-shaped work arm 52 is shown for clarity. Each of the inverted U-shaped work arms 52 comprises a horizontal beam 54 arranged to slide laterally relative to the work head frame 40. Rollers, pads, bearings, lubricants or other friction reducing devices may be arranged between the beams 54 of the work arms 52 and the work head frame 40 to assist in the slidability of the work arms relative to the work head frame. The work arms 52 each include a first outboard depending arm 56 which is secured at a top end 58 to a lateral outboard end 60 of the horizontal beam 54 and which has a free bottom end 62, and a second lateral inboard depending arm 64 being secured at a top end 66 to an opposite, lateral inboard end 68 of the horizontal beam with a free bottom end 70.

Each of the work arms 52 has a replaceable tool 72, 74 secured to each free bottom end 62, 70 of the inverted U-shaped work arm. In the illustrated embodiment, the replaceable tool 72 mounted to the free bottom end 62 of the first outboard depending arm 56 extends laterally toward the free bottom end 70 of the second inboard depending arm 64 and the replaceable tool 74 mounted to the free bottom end 70 of the second inboard depending arm 64 extends laterally toward the free bottom end 62 of the first outboard depending arm 56.

Figure 4:
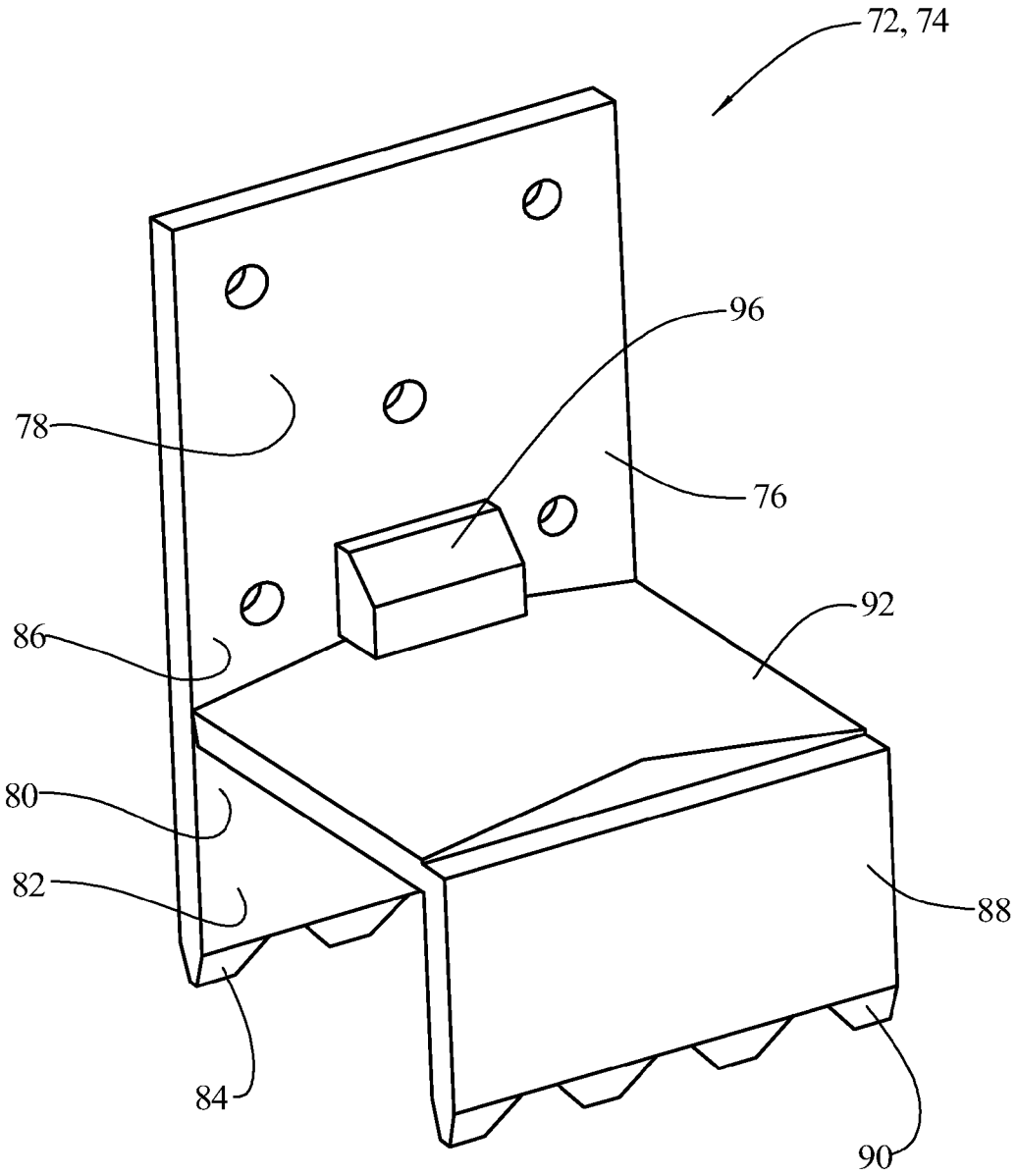
FIG. 4 is an isolated top perspective view of a replaceable tool for use with the cribbing machine of FIG. 1.
Figure 5:
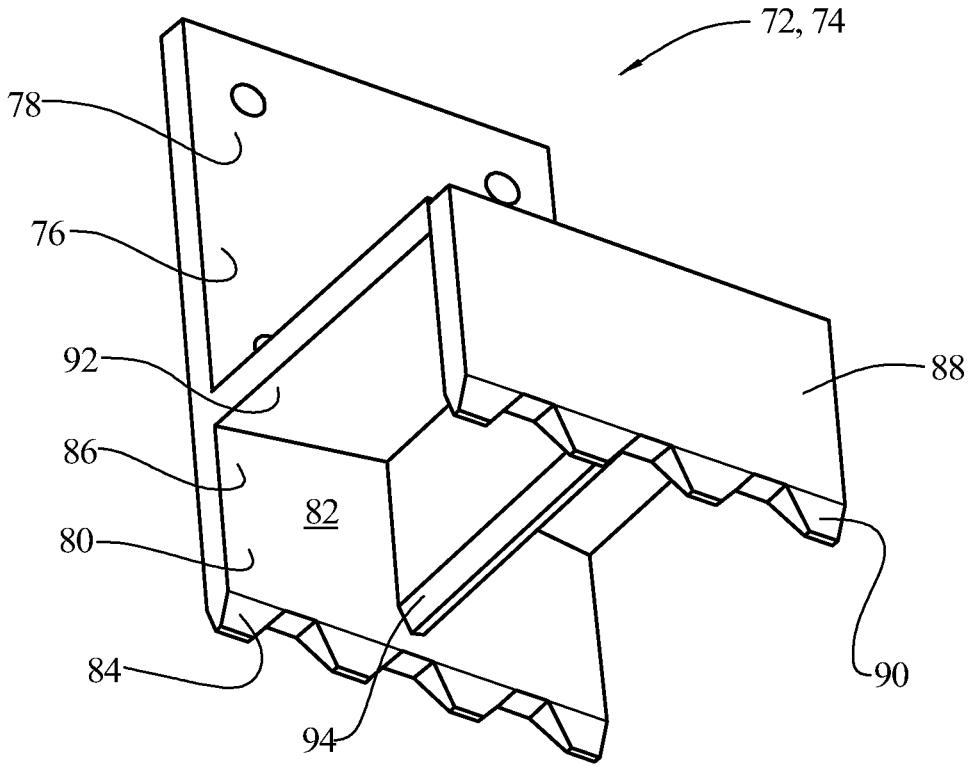
FIG. 5 is an isolated bottom perspective view of a replaceable tool for use with the cribbing machine of FIG. 1.

As best seen in FIGS. 4 and 5, the replaceable tools 72, 74, which are identical to each other, include a tool body 76 having a mounting area 78 and a first ballast pusher end 80. The first ballast pusher end 80 includes at least one substantially vertical surface 82 and may have a lower serrated edge 84. Preferably the lower serrated edge 84 is a hardened metal since it comprises a wear surface which will be in scraping engagement with the ballast 22. The mounting area 78 and the first ballast pusher end 80 may be formed on a single plate 86 which is arranged generally vertically when removably attached, such as by bolts, to the free bottom end 62, 70 of the first or second depending arms 56, 64.

The tool body 76 also has a generally vertically extending second ballast pusher end 88 spaced from the first ballast pusher end 80. The second ballast pusher end 88 may also have a lower serrated edge 90. The lower serrated edge 90 of the second ballast pusher end 88 is also preferably a hardened metal material.

In the embodiment illustrated, the first ballast pusher end 80 is held apart from the second ballast pusher end 88 by a substantially horizontal wall 92. The first ballast pusher end 80 may also be held apart from the second ballast pusher end 88 by a substantially vertical wall 94, or by both the horizontal wall 92 and the vertical wall 94. The various walls of the tool body 76 may be joined, such as by welding. Additional supports or gussets 96 may be provided between the walls to strengthen the tool 72, 74 as desired. In operation, as discussed below, the tool 72, 74 is used to push ballast 22 laterally and in some instances may be used to push ballast beneath the rail 34 of the railway track 28. Therefore, the tool 72, 74 has a horizontal extent sufficient to reach across a width of a base 98 (FIG. 10) of the rail 34, and may be in the range of about 4 to 10 inches from the mounting area 78 to the second ballast pusher end 88.

A width of each of the first ballast pusher ends 80 and the second ballast pusher ends 88, which extend in a longitudinal direction when the tools 72, 74 are mounted on the arms 56, 64, is selected to be no greater in extent than a smallest expected longitudinal dimension of a crib 24 so that the tools will not engage either adjacent tie as they are moved in a particular crib. For example, a reasonable width for such tools may be in the range of 4 to 10 inches.

As shown in FIG. 3, a separate fluid power double cylinder 100 is secured to the work head frame 40, such as at a depending attachment ear 101, and to each of the inverted U-shape work arms 52 for independently laterally reciprocating the work arms. The fluid power double cylinder 100 for the left side work arm 52 is mounted to the ear 101 at the right end of the work head frame 40 and the fluid power double cylinder 100 for the right side work arm is mounted to the ear at the left end of the work head frame. Thus, the right and left work arms 52 are mounted in opposite orientations.

A main cylinder 102 of each of the fluid power double cylinders 100 is operable to laterally reciprocatingly move a respective work arm 52 and a secondary cylinder 104 of each of the fluid power double cylinders is operable to move a respective work arm to one of two discrete lateral starting points. In the embodiment illustrated, each of the fluid power double cylinders 100 comprises the main cylinder 102 secured to an end of the secondary cylinder 104 such that the main cylinder and the secondary cylinder are arranged on a common axis. The main cylinder 100 is mounted and oriented such that it can move its respective inverted U-shaped work arm 52 in either lateral direction (arrow 53).

A control system 106 (FIG. 2) is connected to each of the fluid power double cylinders 100 to selectively operate the main cylinders 102 and secondary cylinders 104 to laterally move the work arms 52 in a manner depending on an operational sequence determined by the control system. In an embodiment, the main cylinder 102 of each of the fluid power double cylinders 100 includes an internal sensor 108 arranged to provide position feedback to the control system 106 such that an extension position of the main cylinder 102 can be controlled by the control system. For example, the control system 106 includes a PLC controller.

In an embodiment, a tie pusher 110 (FIG. 26) is mounted on the machine frame 32 and is arranged to push a tie 112 in a longitudinal direction relative to the machine frame. The tie pusher 110 may be moved by an appropriate mechanism, such as hydraulic cylinders 111, in the longitudinal direction toward and away from the tie. The tie pusher may also be moved between a raised and a lowered position, as needed.

In operation, the cribbing machine 20 is moved along the railway track 28 to a point where the work head frame 40 (in the raised position shown in FIGS. 6, 12, 18) is positioned over a tie 112 that needs to be replaced. In order to replace the tie 112, the ballast 22 must be removed from around the tie so that the tie may be easily removed. A determination is made regarding whether the ballast 22 is to be moved to the first lateral side 26 of the railway track 28, the opposite lateral side 30 or to both sides. Factors that are considered in making this determination include the space available to either side of the railway track 28 for the removed ballast 22, such as the location of adjacent railway track or the slope of the track foundation, as well as other factors.

Once the determination is made regarding the location of the moved ballast 22, the control system 106 will operate the secondary cylinders 104 to place the work arms 52 in a correct starting location for the determined movement for the ballast. For example, if the ballast 22 is to be moved to both sides 26, 30 of the railway track 28, as shown in FIGS. 6-11, a first work arm 52, located on the left side of the work head frame 40 as viewed in the drawings, and shown in isolation in FIG. 3, is positioned by first having the control system 106 move the main cylinder 102, if necessary, to a retracted position **102*a* and moving the secondary cylinder 104, if necessary, to an extended position 104*a*. This will be the home position for the first work arm 52**.

The second work arm 52, located on the right side of the work head frame 40, as viewed in the drawings, will also be positioned by first moving the main cylinder 102, if necessary, to the retracted position **102*a* and moving the secondary cylinder 104, if necessary, to the extended position 104*a*. This initial position is referred to as the home position. In this home position, for both work arms 52, the laterally outward tool 72 will have its second ballast pusher end 88 positioned just outboard of a field side 114 of the rail 34. Also in this home position, the laterally inward tool 74 will have its first ballast pusher end 80 positioned approximately at the centerline of the bed of the railway track 28 (FIG. 6**).

Figure 7:
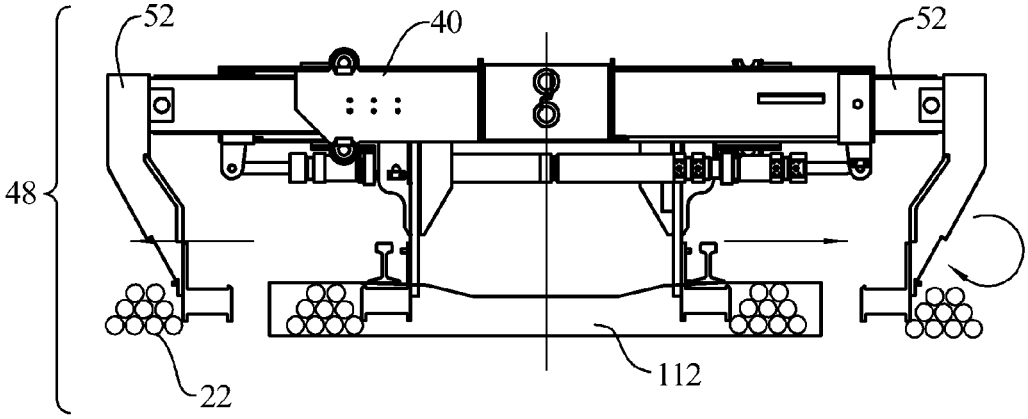
FIG. 7 is a schematic view of the pair of work arms of FIG. 6 at the end of the movement of pushing ballast to both lateral sides of the track FIG. 8 an elevational view of one work arm carried on a work head frame and positioned to push ballast laterally outwardly as seen looking in a longitudinal direction of the cribbing machine of FIG. 1.
Figure 8:
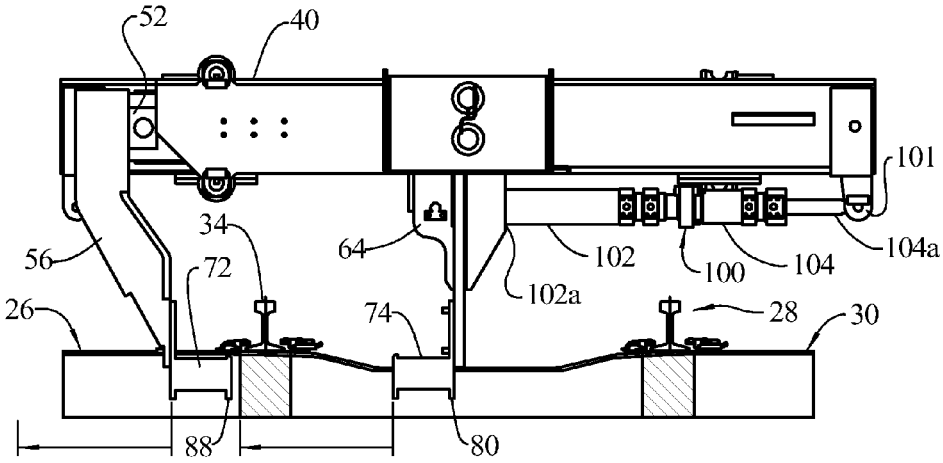

The work head frame 40 is then lowered by the control system 106, such as by operating a lowering hydraulic cylinder, to the working position 48 (FIGS. 7 and 10) so that the lower serrated edges 84, 90 of the tools 72, 74 will engage into the ballast 22 (FIGS. 8 and 10). FIG. 8 shows only the left work arm 52 and its associated fluid power double cylinder 100 for clarity.

Figure 9:
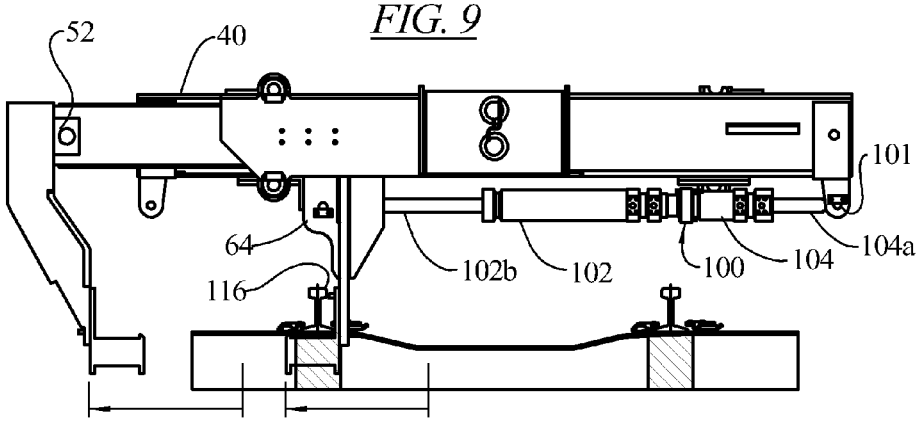
FIG. 9 is an elevational view of the work arm of FIG. 8 at an end of travel position after pushing ballast laterally outwardly.
Figure 11:
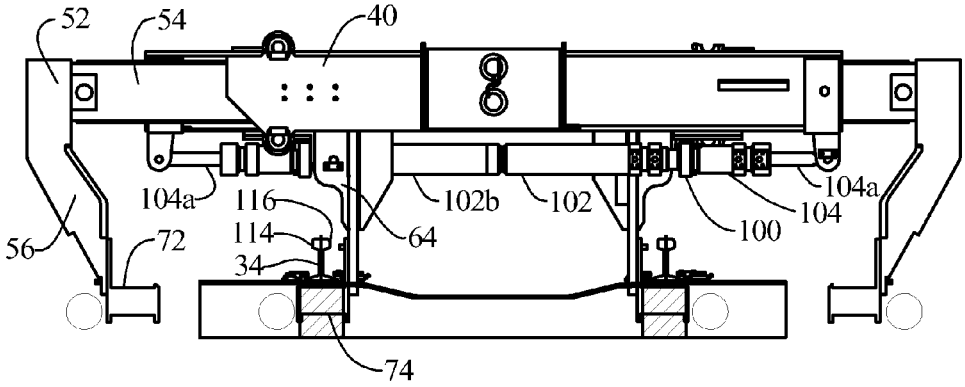
FIG. 11 is an elevational view of the work arms of FIG. 10 at an end of travel position after pushing ballast laterally outwardly.

The main cylinders 102 are then moved to an extended position 102*b* by the control system 106 causing the work arms 52 to move laterally outwardly (away from the centerline of the railway bed), pushing ballast 22 in a laterally outward direction with the ballast being engaged by the first ballast pusher end 80 and the second ballast pusher end 88 of each tool 72, 74 (FIGS. 9 and 11). The laterally outward tool 72 will push the ballast 22 away from the field side 114 of the rail 34 and the laterally inward tool 74 will push the ballast 22 from the middle of the railway bed toward a gage side 116 of the rail. When the work arms 52 have moved a lateral distance determined by the internal sensors 108 in the main cylinders 102 to avoid contact by the tool 74 or arm 64 with the rail 34, the control system 106 will cause the work head frame 40 to be lifted to the raised position, if no interference with the rail 34 would occur, and will independently cause the main cylinders to retract, returning the work arms to the home position (FIG. 6).

The work head frame 40 is then again lowered by the control system 106 to place the lower serrated edges 84, 90 of the tools 72, 74 into engagement with the ballast 22 and the described movement of the work arms 52 is repeated as many times as is necessary to remove the ballast to a level below the tie 112. Once enough of the ballast 22 is moved away from the tie 112 on the field side 114 of the rail 34, ballast on the gage side 116 of the track can be pushed beneath the rail by the laterally inward tool 74 (FIGS. 7, 9, 11). This is possible because that tool 74 projects laterally outwardly away from the second depending arm 64 which allows the second ballast pusher end 88 to move completely beneath the rail 34 to the field side 114 of the rail without the second depending arm engaging the gage side 116 of the rail.

Figure 23:
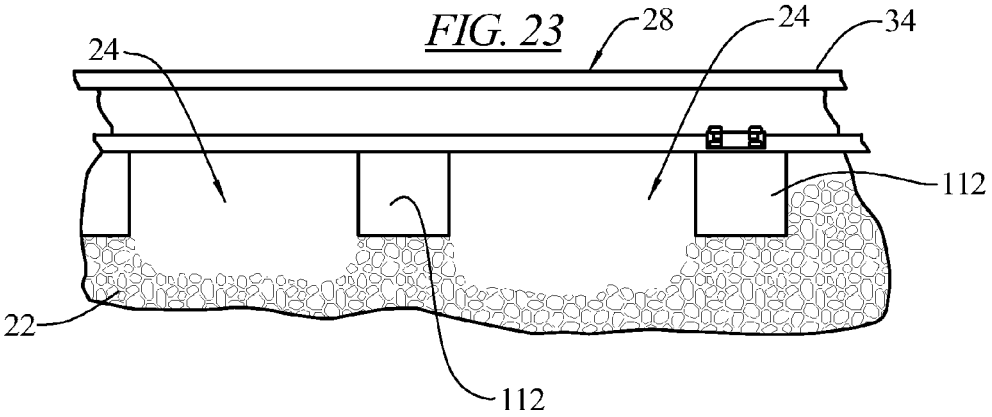
FIG. 23 is a side view of the track and ballast area after the ballast has been cleared by the cribbing machine of FIG. 1.

With two work arms 52 arranged in one crib 24, the ballast 22 on one longitudinal side of the tie 112 can be displaced laterally away from the tie. If four work arms 52 are provided on the work head frame 40 carried on the machine frame 32, then the cribs 24 on both longitudinal sides of the tie 112 can be cleared of ballast 22 at the same time (FIG. 23). In some procedures, it is necessary or desirable to remove the ballast 22 to a level well below a bottom of the tie 112 in order to create a trough in the crib 24 adjacent to the tie.

Figure 13:
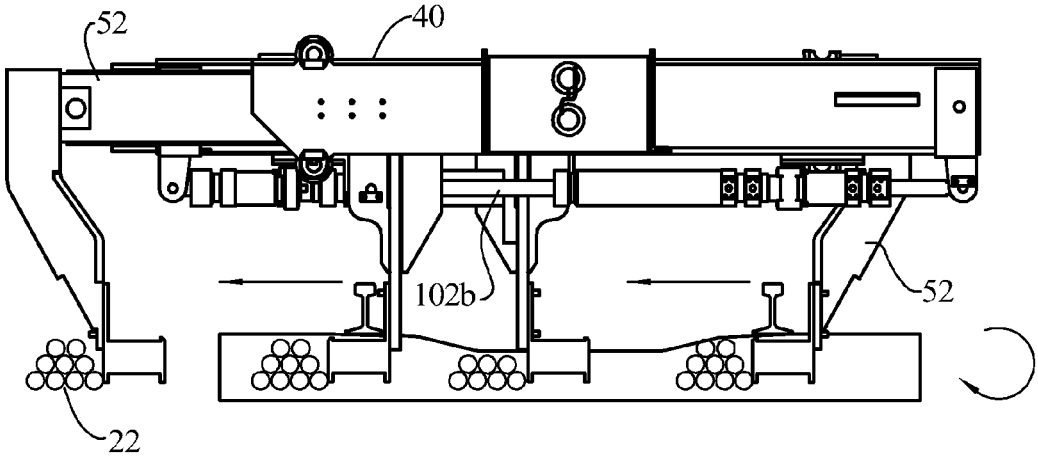
FIG. 13 is a schematic view of the pair of work arms of FIG. 6 at the end of the movement of pushing ballast to the left lateral side of the track.
Figure 14:
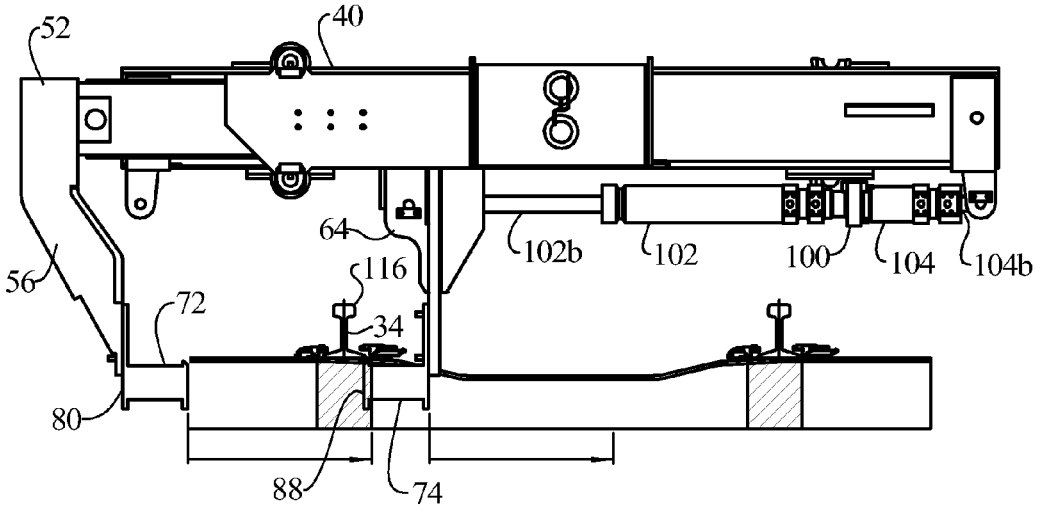
FIG. 14 is an elevational view of one work arm carried on a work head frame and positioned to push ballast laterally inwardly as seen looking in a longitudinal direction of the cribbing machine of FIG. 1.
Figure 15:
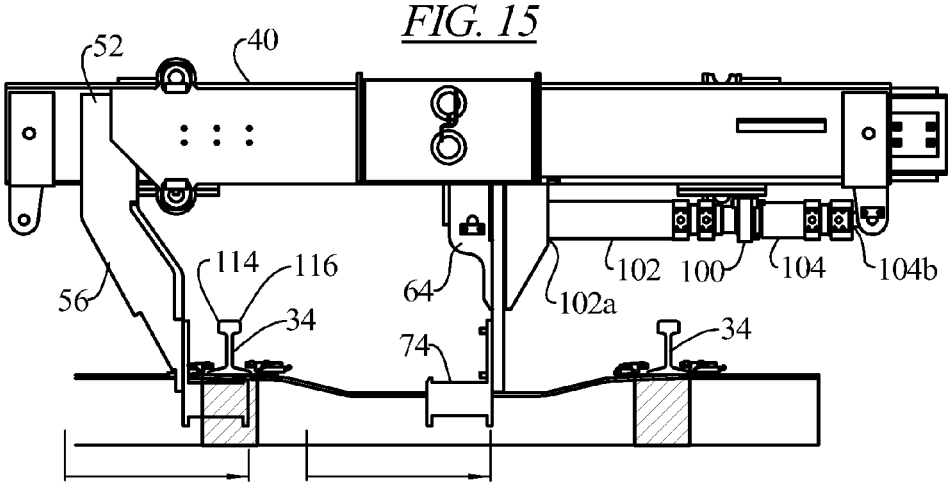
FIG. 15 is an elevational view of the work arm of FIG. 14 at an end of travel position after pushing ballast laterally inwardly.
Figure 16:
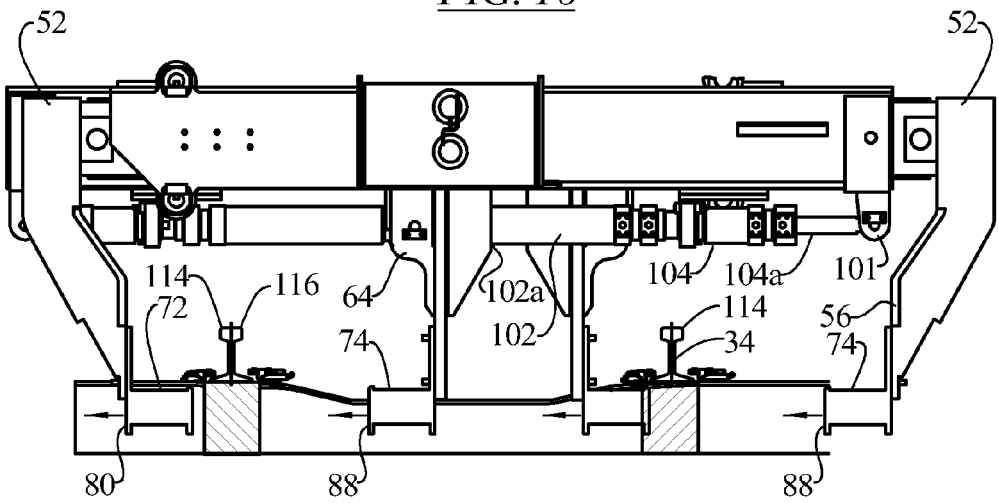
FIG. 16 an elevational view of two work arms carried on a work head frame and positioned to push ballast laterally left as seen looking in a longitudinal direction of the cribbing machine of FIG. 1.

In a second example, if the ballast 22 is to be moved to only the first (left) side 26 of the track 28, as shown in FIGS. 12-17, for the first (left) work arm 52, the control system 106 operates to move the main cylinder 102, if necessary, to the retracted position 102*a* and the secondary cylinder 104 of the left work arm is moved, if necessary, to the extended position 104*a*, as in the first example (FIG. 8). However the second (right) work arm 52 is moved differently, such that the main cylinder 102 is moved by the control system 106, if necessary, to an extended position 102*b* and the secondary cylinder 104 is moved, if necessary, to a retracted position 104*b*. This position is shown in FIG. 14, if the work head frame 40 is viewed from the opposite side from the viewing side of FIG. 8. In this home position for the second example (FIG. 12), the left work arm 52 will be positioned as in the first example, but the right work arm will be positioned such that the laterally inward tool 74 has its second ballast pusher end 88 positioned just laterally inside of the gage side 116 of the right rail and the laterally outward tool 72 will have its first ballast pusher end 80 positioned laterally outside of an end 117 of the tie 112 (FIG. 12, 16).

The work head frame 40 is then lowered by the control system 106 to the working position 48 (FIGS. 14, 16) so that the lower serrated edges 84, 90 of the tools 72, 74 will engage into the ballast 22. FIG. 14 shows only the right working arm 52 and its associated fluid power cylinder 100 (from a backside of the work head frame 40), for clarity.

Figure 17:
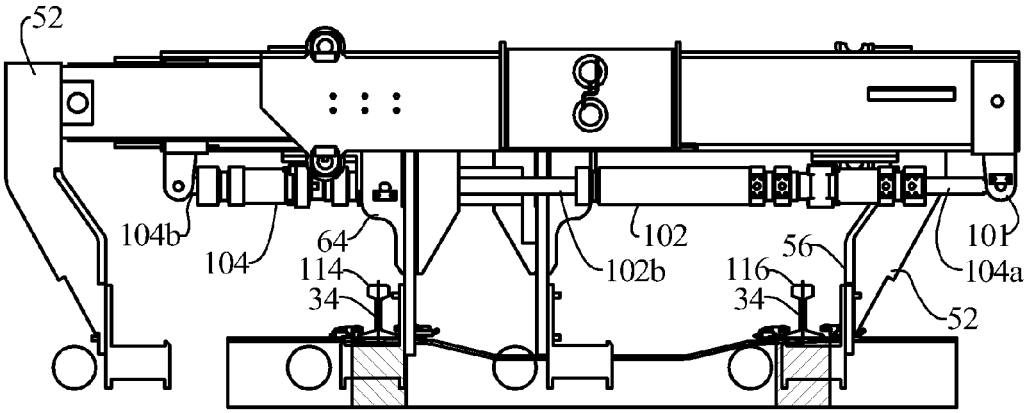
FIG. 17 is an elevational view of the work arms of FIG. 10 at an end of travel position after pushing ballast laterally to the left.

The left main cylinder 102 is then moved to the extended position 102*b* causing the left work arm 52 to move laterally outwardly to the left, pushing ballast 22 in an outward direction with the ballast being engaged by the first ballast pusher end 80 and the second ballast pusher end 88 of each tool 72, 74 (FIGS. 13, 17). The laterally outward tool 72 will push the ballast 22 away from the field side 114 of the rail 34 and the laterally inward tool 74 will push the ballast 22 toward the gage side 116 of the rail.

The right main cylinder 102 is simultaneously, but independently, retracted causing the right work arm 52 to move laterally inwardly (to the left) (FIGS. 13, 17). When the work arms 52 have moved a lateral distance determined by the internal sensor 108 in the main cylinder 102 to avoid contact by the tool 74 or the depending arm 70 with the rail 34, the control system 106 will cause the work head frame 40 to be lifted, if no interference with the rail would occur, and to cause the left main cylinder to retract and the right main cylinder to extend, returning the work arms 52 to the home position (FIG. 12).

The work head frame 40 is then again lowered to place the lower serrated edges 84, 90 of the tools 72, 74 into engagement with the ballast (FIG. 16) and the described movement of the work arms 52 is repeated as many times as is necessary to remove the ballast to a level below the tie 112. Once enough of the ballast 22 is moved away from the tie 112 on the field side 114 of the leftmost rail 34, ballast on the gage side 116 of the rail can be pushed beneath the rail by the laterally inward tool 74 since that tool projects laterally outwardly away from the second depending arm 64 which allows the second ballast pusher end 88 to move completely beneath the rail to the field side 114 of the rail without the second depending arm striking the gage side of the rail (FIGS. 13, 17).

Also, as soon as enough of the ballast 22 is moved away from the tie 112 on the gage side 116 of the rightmost rail 34, ballast on the field side 114 of the rail can be pushed beneath the rail by the laterally outward tool 72 since that tool projects laterally inwardly away from the first depending arm 56 which allows the second ballast pusher end 88 to move completely beneath the rail to the gage side of the rail without the first depending arm striking the field side of the rail.

With two work arms 52 arranged in one crib 24, the ballast 22 on one longitudinal side of the tie 112 can all be displaced laterally to the left side of the tie. If four work arms 52 are provided on the work head frame 10 carried on the machine frame 32, then the cribs 24 on both longitudinal sides of the tie 112 can be cleared of ballast 22 at the same time (FIG. 23). In some procedures, it is necessary or desirable to remove the ballast 22 to a level well below a bottom of the tie 112 in order to create a trough in the crib 24 adjacent to the tie.

In a third example, if the ballast 22 is to be moved to only the second (right) side 26 of the track 28, as shown in FIGS.

Figure 20:
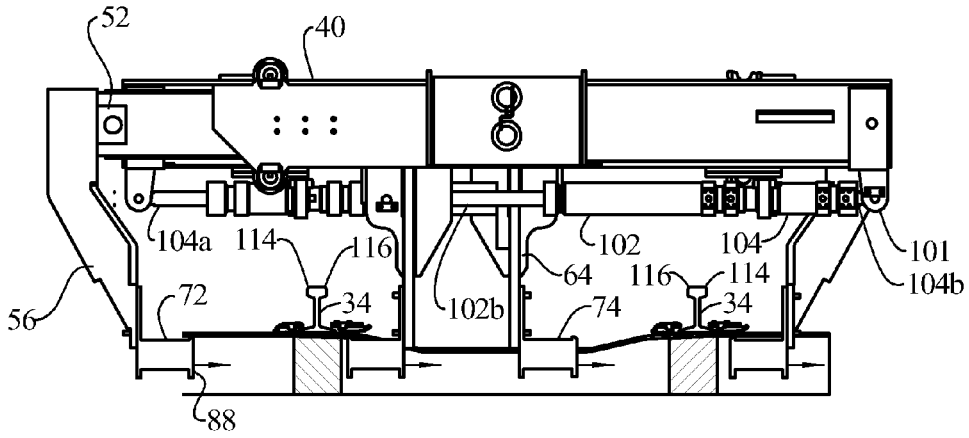
FIG. 20 is an elevational view of two work arms carried on a work head frame and positioned to push ballast laterally to the right as seen looking in a longitudinal direction of the cribbing machine of FIG. 1.

18-21, for the first (left) work arm 52, the main cylinder 102 is moved, if necessary, by the control system 106 to the extended position 102*b* and the secondary cylinder 104 of the left work arm is moved, if necessary, to the retracted position 104*b*. This position is shown in FIG. 14 if the left arm 52 is viewed from the same side as FIG. 20.

However, the second (right) work arm is 52 moved differently, such that the main cylinder 102 is moved, if necessary, to the retracted position 102*a* and the secondary cylinder 104 is moved to the extended position 104*a*, as in the first example. FIG. 14 shows this position of the right arm 52 when viewed from an opposite side of the work arm frame 40 as FIG. 20. In this home position (FIG. 18) for the third example, the left work arm 52 will be positioned such that the laterally inward tool 74 has its second ballast pusher end 88 positioned laterally just inside of the gage side 116 of the left rail 34 and the laterally outward tool 72 will have its first ballast pusher end 80 positioned laterally outside of the end 117 of the tie 112, but the right work arm will be positioned as in the first example.

The work head frame 40 is then lowered by the control system 106 operating means 111 to the working position 48 (FIG. 20) so that the lower serrated edges 84, 90 of the tools 72, 74 will engage into the ballast 22. The left main cylinder 102 is then moved to the retracted position 102*a* causing the left work arm 52 to move laterally inwardly to the right, pushing ballast 22 in an inward direction with the ballast being engaged by the first ballast pusher end 80 and the second ballast pusher end 88 of each tool 72, 74. The laterally outward tool 72 will push the ballast 22 toward from a field side 114 of the rail 34 and the laterally inward tool 74 will push the ballast toward the centerline of the track (FIGS. 19, 21).

Figure 19:
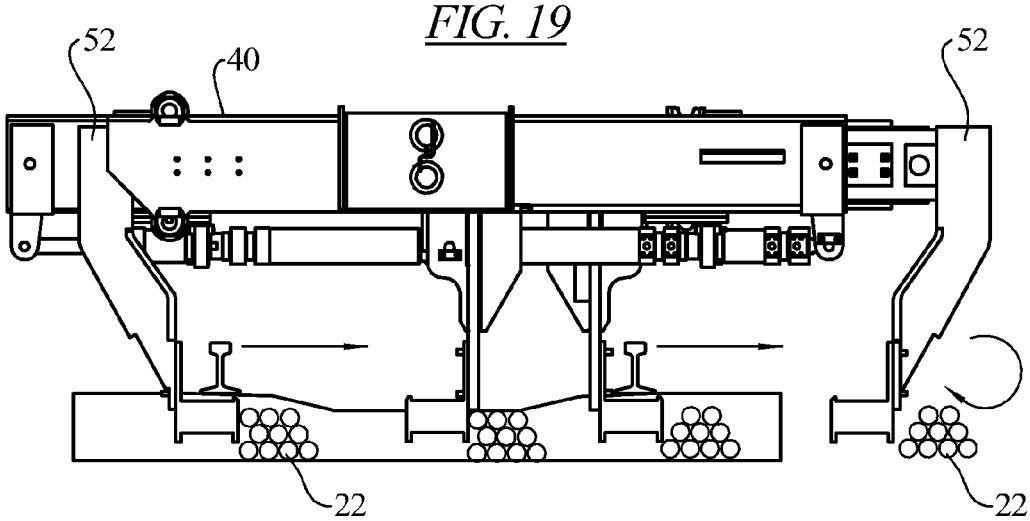
FIG. 19 is a schematic view of the pair of work arms of FIG. 18 at the end of the movement of pushing ballast to the right lateral side of the track.
Figure 21:
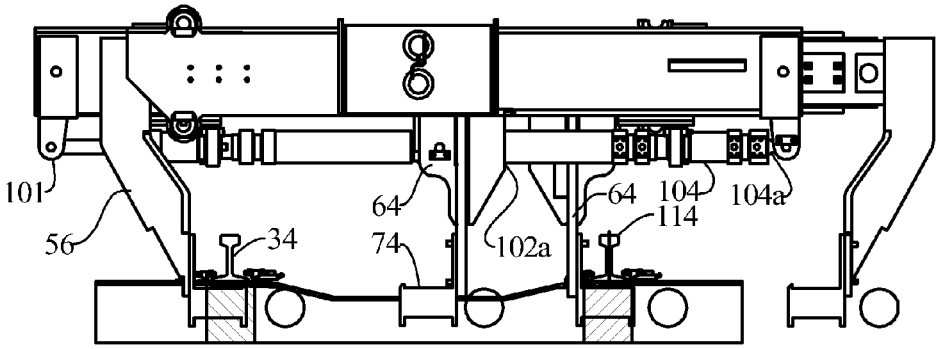
FIG. 21 is an elevational view of the work arms of FIG. 10 at an end of travel position after pushing ballast laterally to the right.
Figure 22:
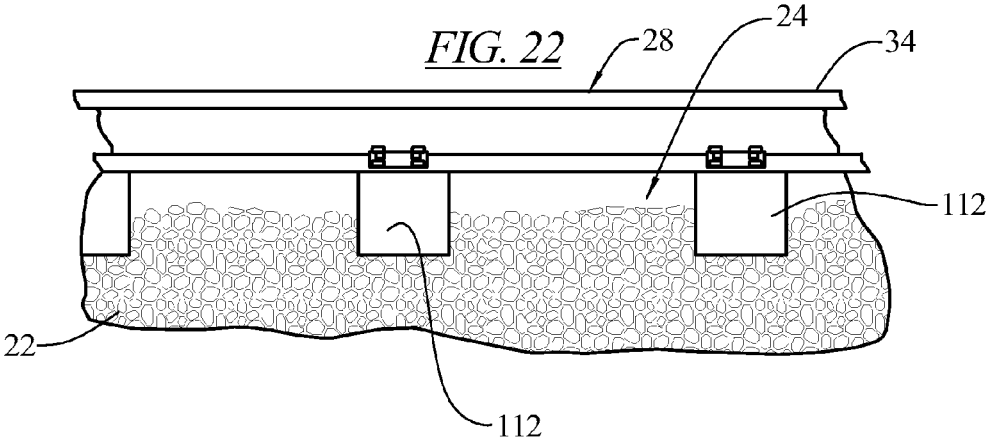
FIG. 22 is a side view of the track and ballast area to be worked on by the cribbing machine of FIG. 1.

The right main cylinder 102 is simultaneously, but independently, extended causing the right work arm 52 to move laterally outwardly (to the right) (FIGS. 19, 21). When the work arms 52 have moved a lateral distance determined by the internal sensor 108 in the main cylinder 102 to avoid contact by the tools 72, 74 with the rail 34, the control system 106 will cause the work head frame 40 to lift, if no interference with the rail would occur, and to cause the left main cylinder to extend and the right main cylinder to retract, returning the work arms 52 to the home position (FIG. 18).

The work head frame 40 is then again lowered by the control system 106 to place the lower serrated edges 84, 90 of the tools 72, 74 into engagement with the ballast 22 (FIG. 20) and the described movement of the work arms 52 is repeated as many times as is necessary to remove the ballast to a level below the tie 112. Once enough of the ballast 22 is moved away from the tie 112 on the field side 114 of the rightmost rail 34, ballast on the gage side 116 of the rail can be pushed beneath the rail by the laterally inward tool 74 (FIG. 21) since that tool projects laterally outwardly away from the second depending arm 64 which allows the second ballast pusher end 88 to move completely beneath the rail to the field side 114 of the rail without the second depending arm striking the gage side 116 of the rail.

Also, as soon as enough of the ballast 22 is moved away from the tie 112 on the gage side 116 of the leftmost rail 34, ballast on the field side 114 of the left rail can be pushed beneath the rail by the laterally outward tool 72 since that tool projects laterally inwardly away from the first depending arm 56 which allows the second ballast pusher end 88 to move completely beneath the rail to the gage side of the rail without the first depending arm striking the field side of the rail.

With two work arms 52 arranged in one crib 24, the ballast 22 on one longitudinal side of the tie 112 can all be displaced laterally to the right side of the tie. If four work arms 52 are provided on the work head frames carried on the machine frame 32, then both longitudinal sides of the tie 112 can be cleared of ballast 22 at the same time (FIG. 23). In some procedures, it is necessary or desirable to remove the ballast 22 to a level well below a bottom of the tie 112 in order to create a trough in the crib 24 adjacent to the tie.

Figure 24:
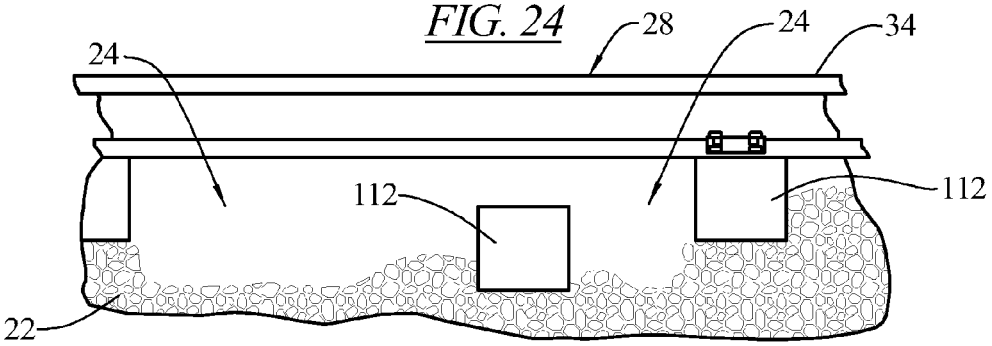
FIG. 24 is a side view of the track and ballast area after the tie has been moved by the cribbing machine of FIG. 1.
Figure 25:
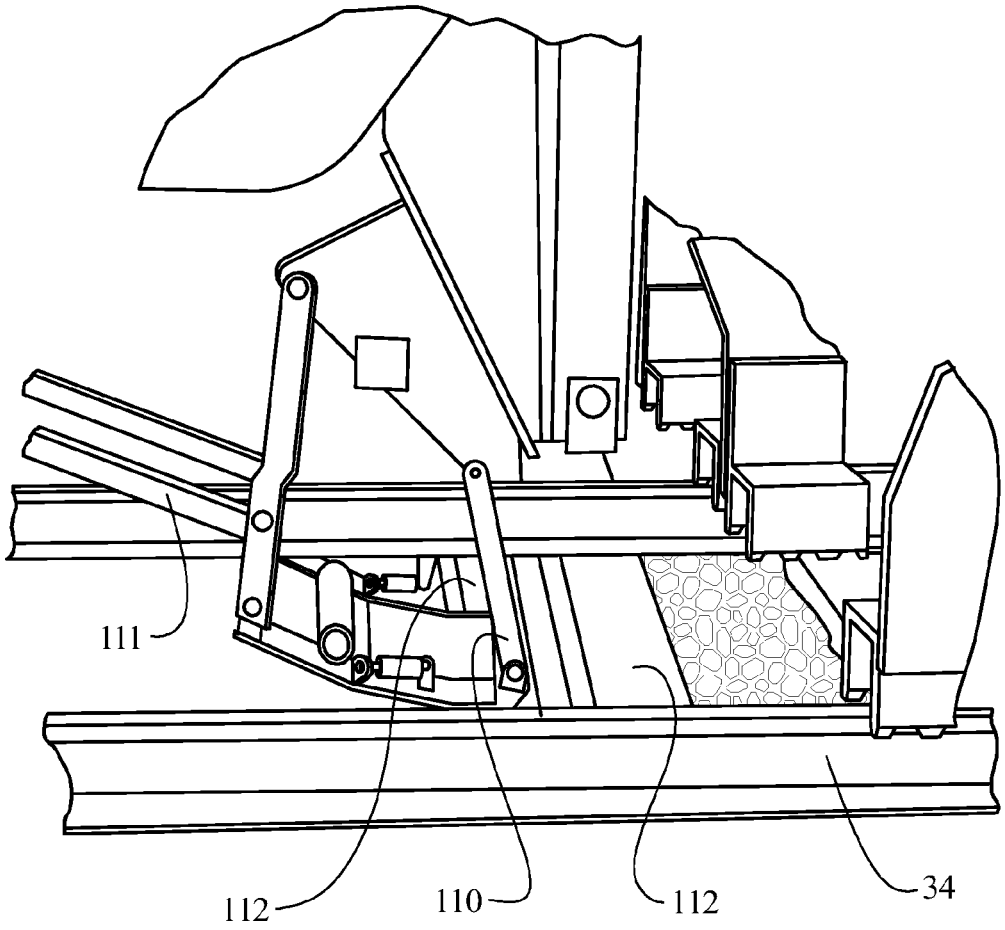
FIG. 25 is a side elevational view of a tie pusher mounted on the machine frame.

After ballast 22 has been removed from both longitudinal sides of the tie 112, by one of the described operations (FIG. 23), the cribbing machine 20 is repositioned so that the tie pusher 110 is positioned adjacent to the cleared tie. Once any clips securing the tie 112 to the rail 34 are released, the control system 106 operates to lower the tie pusher 110 engagement with a side of the tie, and the tie is pushed in a longitudinal direction of the rail 34 so that the tie will fall into a cleared crib, allowing the tie to drop relative to the rail (FIG. 24). Once the tie 112 has dropped away from the rail 34, it can be removed by pulling or pushing the tie in a lateral direction relative to the rail.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A cribbing work head, comprising:

a work head frame having a longitudinal extent and a lateral extent;

at least two inverted U-shaped work arms mounted parallel to one another on said work head frame and spaced longitudinally from each other for lateral reciprocating movement on said frame, each of said work arms having a replaceable tool secured to each free end of said inverted U-shaped work arm;

a separate fluid power double cylinder secured to said work head frame and to each of said inverted U-shape work arms for independently laterally reciprocating said work arms;

a main cylinder of each of said fluid power double cylinders operable to laterally reciprocatingly move a respective work arm and a secondary cylinder of each of said fluid power double cylinders operable to move a respective work arm to one of two discrete lateral starting points.

2. The cribbing work head of claim 1, wherein each of said inverted U-shaped work arms comprises a horizontal beam arranged to slide laterally relative to said work head frame, a first depending arm secured at a top end to one end of said horizontal beam and having one of said replaceable tools removably mounted to a bottom end thereof, and a second depending arm secured at a top end to an opposite end of said horizontal beam and having one of said replaceable tools removably mounted to a bottom end thereof.

3. The cribbing work head of claim 2, wherein said replaceable tool mounted to said first depending arm extends laterally toward said second depending arm and said replaceable tool mounted to said second depending arm extends laterally toward said first depending arm.

4. The cribbing work head of claim 1, wherein each of said fluid power double cylinders comprises said main cylinder secured to an end of said secondary cylinder such that said main cylinder and said secondary cylinder are arranged on a common axis.

5. The cribbing work head of claim 1, wherein each tool extends laterally from said end of said inverted U-shaped work arm for a distance of 4 to 10 inches.

6. The cribbing work head of claim 1, wherein said main cylinder is mounted and oriented such that it can move its respective inverted U-shaped work arm in either lateral direction.

7. The cribbing work head of claim 1, wherein said at least two inverted U-shaped work arms comprises four inverted U-shaped work arms.

8. A cribbing machine configured for selectively moving ballast from at least one railway crib to one lateral side of the railway track, to an opposite side of the railway track, or to both lateral sides of the railway track, comprising:

a machine frame having a front frame end and a rear frame end and extending in a longitudinal direction from said front frame end to said rear frame end;

a work head frame having a longitudinal extent and a lateral extent mounted laterally on said machine frame and being reciprocably movable vertically relative to the railway track between a working position and a travel position;

at least two inverted U-shaped work arms mounted parallel to one another on said work head frame and spaced longitudinally from each other for lateral reciprocating movement on said work head frame, each of said work arms having a replaceable tool secured to each free end of said inverted U-shaped work arm;

a separate fluid power double cylinder secured to said work head frame and to each of said inverted U-shape work arms for independently laterally reciprocating said work arms;

a main cylinder of each of said fluid power double cylinders operable to laterally reciprocatingly move a respective work arm and a secondary cylinder of each of said fluid power double cylinders operable to move a respective work arm to one of two discrete lateral starting points; and a control system connected to each of said fluid power double cylinders to selectively operate said main cylinders and secondary cylinders to laterally move said work arms in a manner depending on an operational sequence determined by said control system.

9. The cribbing machine of claim 8, including a tie pusher mounted on said machine frame and arranged to push a tie in a longitudinal direction relative to said machine frame.

10. The cribbing machine of claim 8, wherein said main cylinder of each of said fluid power double cylinders includes an internal sensor arranged to provide position feedback to a controller such that an extension position of said main cylinder can be controlled by said controller.

11. The cribbing machine of claim 10, wherein said controller is a PLC controller.

12. The cribbing machine of claim 8, wherein each of said inverted U-shaped work arms comprises a horizontal beam arranged to slide laterally relative to said work head frame, a first depending arm secured at a top end to one end of said horizontal beam and having one of said replaceable tools removably mounted to a bottom end thereof, and a second depending arm secured at a top end to an opposite end of said horizontal beam and having one of said replaceable tools removably mounted to a bottom end thereof.

13. The cribbing machine of claim 8, wherein said replaceable tool mounted to said first depending arm extends laterally toward said second depending arm and said replaceable tool mounted to said second depending arm extends laterally toward said first depending arm.

14. The cribbing machine of claim 8, wherein said at least two inverted U-shaped work arms comprises four inverted U-shaped work arms.

15. A tool for use with a rail maintenance cribber having at least one laterally moving work arm having a downwardly facing free end, said tool configured for attachment to said downwardly facing free end and comprising:

a tool body having a mounting area and a first ballast pusher end wall at one lateral end of the tool, said first ballast pusher end wall including at least one substantially vertical surface; and said tool body having a substantially vertically extending second ballast pusher end wall spaced from and substantially parallel to said first ballast pusher end wall at an opposite lateral end of the tool.

16. The tool of claim 15 wherein said first ballast pusher end has a lower serrated edge.

17. The tool of claim 15 wherein said second ballast pusher end has a lower serrated edge.

18. The tool of claim 15 wherein said first ballast pusher end wall is held apart from said second ballast pusher end wall by a substantially horizontal wall.

19. The tool of claim 15 wherein said first ballast pusher end wall is held apart from said second ballast pusher end wall by a substantially vertical wall.

20. The tool of claim 15, wherein said mounting area and said first ballast pusher end wall are formed on a single plate.

* * * * *